US008418285B2

(12) United States Patent
Frias

(10) Patent No.: US 8,418,285 B2
(45) Date of Patent: Apr. 16, 2013

(54) INFLATABLE TEMPERATURE CONTROL SYSTEM

(76) Inventor: Jacobo Frias, Bronx, NY (US)

( * ) Notice: Subject to any disclaimer, the term of this patent is extended or adjusted under 35 U.S.C. 154(b) by 346 days.

(21) Appl. No.: 12/785,456

(22) Filed: May 23, 2010

(65) Prior Publication Data

US 2010/0287701 A1 Nov. 18, 2010

Related U.S. Application Data

(63) Continuation-in-part of application No. 12/414,175, filed on Mar. 30, 2009, now Pat. No. 8,151,391.

(30) Foreign Application Priority Data

Sep. 22, 2009 (WO) ..... PCT/US2009/057773

(51) Int. Cl.
*A47C 27/10* (2006.01)

(52) U.S. Cl.
USPC ..... 5/423; 5/421; 5/710

(58) Field of Classification Search ..... 5/421, 423, 5/710, 713, 714, 726, 655.3
See application file for complete search history.

(56) References Cited

U.S. PATENT DOCUMENTS 800,967 A * 10/1905 Young ..... 5/422
3,705,429 A * 12/1972 Nail ..... 5/710
4,225,989 A * 10/1980 Corbett et al. ..... 5/713

* cited by examiner

*Primary Examiner* — Fredrick Conley

(57) ABSTRACT

An inflatable device has non-pressurized ducts and channels formed within the body of the inflatable device when inflated, wherein the inflation pressure of the inflatable device is maintained when the interior of the ducts and channels are exposed to atmospheric pressures allowing fluid to flow through the ducts and channels at substantially lower pressure levels than the inflation pressure of the inflatable device, a plurality of non-pressurized channels and pressurized support columns can be located in substantial proximity to the surface of the inflatable device in contact with the object to be heated or cooled.

26 Claims, 6 Drawing Sheets

INFLATABLE TEMPERATURE CONTROL SYSTEM

CROSS REFERENCE TO RELATED APPLICATIONS

This application is a continuation in part of the U.S. Non-provisional patent application Ser. No. 12/414,175, filed Mar. 30, 2009 now U.S. Pat. No. 8,151,391.

BACKGROUND OF THE INVENTION

This invention relates generally to fluid flow within an inflatable device, and more particularly, to inflatable temperature control systems.

People spend several hours of each day sitting or lying down on a surface, including a bed (e.g., mattress, mattress pad, etc.) or a seat (e.g., office chair, sofa, seating pad, seating cushion, etc.) Since it is often desirable to manage and control the temperature of the surface that contacts the person (e.g., to remove the heat trapped in the contact area), several existing temperature control system solutions attempt to cool or heat the contact surface and/or the person to improve personal comfort.

For example, sofas and other pieces of furniture incorporate electrical and mechanical hardware inside the furniture and below the surface to be heated. Similarly, thermal blankets and mattress pads incorporate electrical heating elements to heat the contact surface. In addition to increasing the cost and complexity of the bed or seat, these systems also increase the risks of hazardous conditions such as fire and electric shock.

Other prior art solutions include the use of mattresses, pads, or blankets through which a conditioned fluid (e.g., air, gases, liquid) is blown or forced to cool or heat the contact surface, and in some cases, air is allowed to flow through openings in the contact surface. For those solutions wherein the conditioned fluid is not pressurized, prior art incorporates resilient and rigid elements (e.g., plastic or foam spacers, spines, tubes, etc.) to provide support for the weight of the person and/or to create passages for the fluid. These resilient and rigid elements increase the rigidness, size, and weight of these solutions, making the devices less portable as they cannot be stored or transported easily. A drawback for these embodiments is the requirement of a relatively thick comfort layer for the user to rest on. Because the comfort layer is a major barrier for providing efficient heat transfer during heating and/or cooling applications, the conditioned air is blown onto the users through a multiplicity of holes in the comfort layer. As a consequence, the conditioned air cannot be configured to flow in a closed loop, rendering these solutions inefficient due to the transfer of extra heat when the incoming air is at ambient temperature.

In some prior art solutions, an effort is made to replace the rigid elements with inflatable parts. For those solutions, the inflatable parts are designed to imitate the springs of a conventional mattress by directly replacing the steel springs found inside these mattresses. These inflatable parts acting as springs are presented in different shapes such as cylindrical, conical, square, etc., and they are installed in an array format extending throughout the inflatable mattress. The goal of these prior art embodiments is to allow the conditioned fluid to travel within the non-pressurized spaces formed between the inflatable parts or inflatable springs. However, the plurality of the inflatable springs does not guarantee an orderly flow of conditioned fluid and therefore the conditioned fluid may not reach the entire surface of the inflatable mattress creating considerable temperature differences on the top surface of the inflatable mattress. In addition, the required quantity of inflatable parts, acting as springs, adds to the complexity of the mattress construction.

Those solutions that continuously provide heating or cooling through a surface of an inflatable device require the pressurization of the conditioned fluid in order to provide support for the weight of a person. The pressurization of the conditioned fluid is normally done by using a compressor unit which compromises the energy efficiency of the heating and/or cooling system. So while these inflatable devices may themselves offer additional portability over prior art solutions (e.g., since the inflatable devices can be folded when not inflated to smaller sizes), the requirement of a large fan/compressor greatly diminishes this portability.

It would be advantageous to provide a temperature control system that overcomes the problems of these prior art solutions by providing a safer heating/cooling system with greater performance in terms of energy efficiency, flexibility, and portability.

SUMMARY OF THE INVENTION

The requirement for a fluid to be pressurized to approximately the same inflation pressure level of an inflatable device in order to establish a fluid flow within the pressurized body of the inflatable device is avoided by designing the inflatable device in such a way that when inflated, non-pressurized ducts and channels are formed within the body of the inflatable device. As a result, the inflation pressure of the inflatable device is maintained when the interior of the ducts and channels is exposed to atmospheric pressures allowing the fluid to flow through the ducts and channels at substantially lower pressure levels than the inflation pressure of the inflatable device. The inflatable device is designed in such a way that any external and internal forces acting upon the ducts and channels generate reaction forces by the inflation pressure of the inflatable chambers next to and surrounding each of the ducts and channels, therefore, preventing the ducts and channels from substantially collapsing. When the above inventive concept is applied for heating or cooling, a plurality of non-pressurized channels and pressurized support columns can be located in substantial proximity to the surface of the inflatable device in contact with the object to be heated or cooled.

DETAILED DESCRIPTION OF THE INVENTION

Figure 1:
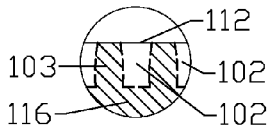
FIG. 1 is a partial sectional view of a conditioned air channel between the inflatable support columns and an external surface of an inflatable device.
Figure 2:
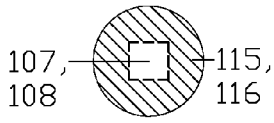
FIG. 2 is a partial sectional view of a conditioned air duct within the pressurized body of an inflatable device.
Figure 3:
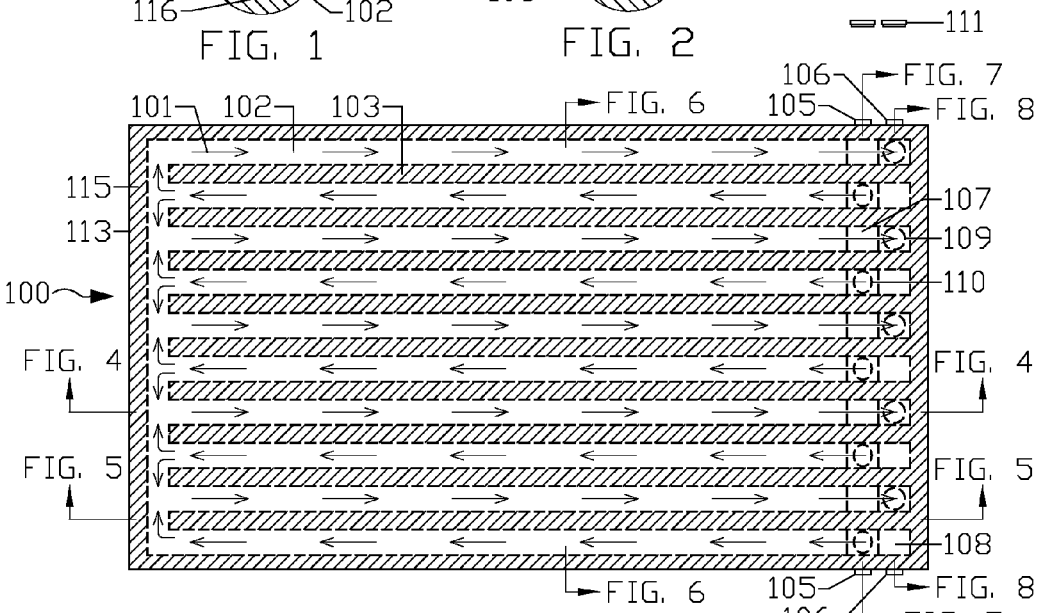
FIG. 3 is a sectional top view of an inflatable mattress with the top surface removed, according to one embodiment of the invention.
Figure 4:
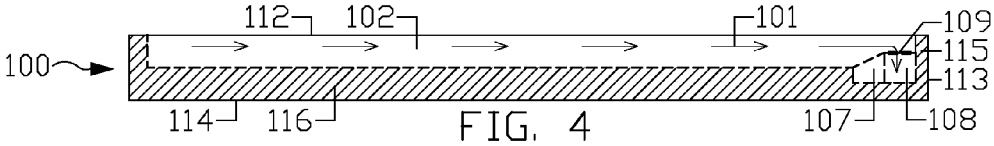
FIG. 4 is a sectional view of the inflatable mattress in FIG. 3 along axis FIG. 4-FIG. 4, illustrating a conditioned air channel and conditioned air ducts.
Figure 5:
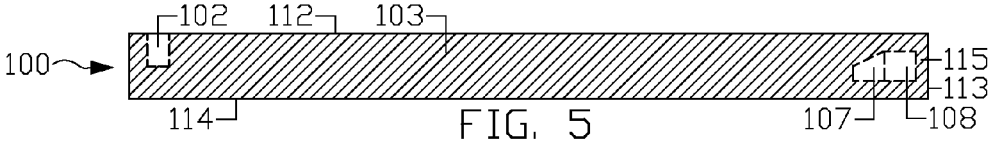
FIG. 5 is a sectional view of the inflatable mattress in FIG. 3 along axis FIG. 5-FIG. 5, illustrating an inflatable support column and conditioned air ducts.

In accordance with the inventive concept, non-pressurized ducts and channels are formed within the pressurized body of an inflatable device. Embodiments of the inventive concept are shown in FIGS. 1 and 2. For the embodiment shown in FIG. 1, when a force (e.g., weight load) is applied on the top surface 112, the inflation pressure of the support columns 103 increases and generates reaction forces that cancel the weight forces acting on the top surface 112 preventing the channel 102 from substantially collapsing or being blocked. For the embodiment shown in FIG. 2, when a force is applied on the inflatable device, the inflation pressure of the inflatable layers 115, 116 generates reaction forces that cancel the forces acting upon the inflatable device preventing the air duct 107, 108 from substantially collapsing or being blocked. As with any inflatable device, internal attachments (not shown) within the pressurized body of the inflatable device shall be provided in order to maintain the desired shape of the inflatable device, the channel 102, and the ducts 107, 108. The balancing effect between the internal attachment tension forces and the inflation pressure of the inflatable support columns 103 and inflatable layer 115, 116 provides enough structural integrity of the inflatable device even when the interior of the non-pressurized air ducts 107, 108 and air channel 102 are subjected to atmospheric or lower pressure levels than the inflation pressure of the inflatable device. The volume of each channel 102, and each duct 107, 108 has a geometric ratio of the length to the equivalent of the diameter of the cross-sectional area greater than five. As will be explained later, the structural strength of the air channels and the air ducts and therefore the likelihood of staying unobstructed due to forces acting upon them is proportional to the pressure level of the inflatable support columns 103 and inflatable layers 115, 116, respectively.

In one embodiment of the invention used as a temperature control system includes an inflatable mattress 100 as shown in FIGS. 3 through 11. The inflatable mattress 100 can include a top surface 112, side wall 113, and bottom surface 114 encompassing one or more inflatable chambers that are inflated through an inflation opening (not shown) through the use of an air compressor or similar device. The inflatable chambers of the inflatable mattress 100 can include an inflatable side layer 115 around its perimeter bounded by the side wall 113, an inflatable bottom layer 116 along its bottom bounded by the bottom surface 114, and a plurality of inflatable support columns 103 distributed throughout its center area bounded by the top surface 112, all inflated with pressurized air. In the drawing figures showing the inflatable device, the hatched areas depict inflatable chambers with pressurized air or spaces subjected to inflation pressures. In addition, different types of hatches shown on the same drawing figure represent air chambers subjected to different inflation pressures.

The inflatable mattress 100 can be constructed using one or more thermoplastic materials (e.g., polyurethane, vinyl PVC (polyvinyl chloride), latex, polyethylene, nylon, rubber, neoprene rubber, chlorosulfonated polypropylene), including those used in conventional air mattresses and similar impermeable materials. As will be discussed, the choice of materials for the different parts of the inflatable mattress is also based on the heat transfer characteristics (i.e., thermal conductivity) of the materials. The impermeable thermoplastic materials 113, 114 surrounding the inflatable layers 115, 116 and the impermeable thermoplastic material forming the inflatable support columns 103 can be made of Polyurethane, Vinyl or similar materials with approximate thickness between 20 mils and 40 mils so as to increase material strength due to higher inflation pressure levels and to minimize heat transfer. On the other hand, the top surface 112 can be made thinner since the top surface 112 is not required to be pressurized and it can be made of Nylon, Lycra, Polyester or similar materials with approximate thickness between 5 mils and 10 mils so as to promote heat transfer. A flocking material made of, e.g., cotton, rayon, nylon, etc., can be applied to the top surface 112 to provide additional comfort. In addition to a smaller thickness, the heat transfer characteristic of the top surface 112 can improve by using materials made of heat-conductive polymers. The thermal conductivity of these polymers is increased by adding conductive fillers. For instance, some compounds used as conductive fillers are graphite fibers and silver, among others.

Figure 6:
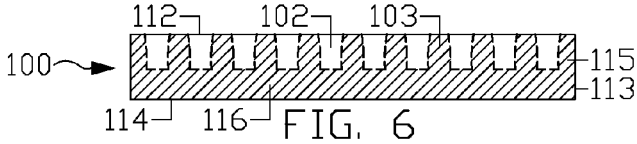
FIG. 6 is a sectional view of the inflatable mattress in FIG. 3 along axis FIG. 6-FIG. 6, illustrating the formation of conditioned air channels between the inflatable support columns and the mattress top surface.
Figure 9:
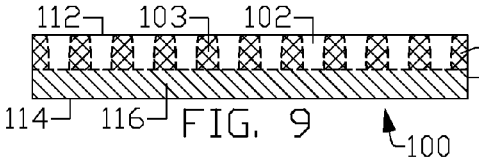
FIG. 9 is a sectional view of the inflatable mattress in FIG. 3 along axis FIG. 6-FIG. 6, illustrating an embodiment with inflatable support columns isolated from the inflatable bottom layer.
Figure 10:
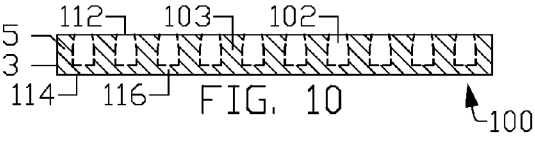
FIG. 10 is a sectional view of the inflatable mattress in FIG. 3 along axis FIG. 6-FIG. 6, in another embodiment illustrating a low profile inflatable bottom layer.
Figure 11:
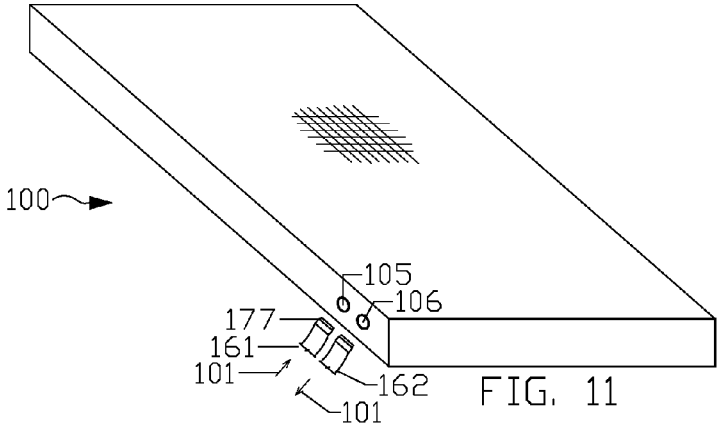
FIG. 11 is a perspective view of the inflatable mattress in FIG. 3, illustrating the interface of the conditioned air supply and return hoses to the supply and return openings.

The inflatable support columns 103 can have a variety of forms and designs. For instance, in order to decrease the disturbances transmitted along a column due to an increase of the column internal pressure when a weight load is applied on the column, each inflatable support column 103 can be sectionalized with multiple internal air compartments. In other embodiments, the inflatable support columns 103 and inflatable layers 115, 116 can be joined together to form a single inflation chamber or designed such that the inflatable support columns 103 are separately inflated at different inflation pressures. For example, FIG. 6 illustrates an embodiment where the inflatable support columns 103 and the inflatable bottom layer 116, inflatable side layers 115, are part of a single inflation chamber. While FIG. 9 illustrates an embodiment where the inflatable support columns 103 are separate from the inflatable layers 115, 116. The inflatable layer 116 provides cushion and thermal isolation. The heat transfer losses between the conditioned air 101 flowing in the channels and the environment decrease when the depth of the inflatable layer 116 increases. In addition, the inflatable layer 116 provides the inflatable support columns 103 with anchoring and resistance to be tilted over. On the other hand, the inflatable layer 116 can be completely eliminated by attaching the inflatable support columns 103 directly to the top and bottom surfaces 112, 114. In other embodiments, the plurality of inflatable support columns 103 may be part of two separate inflatable support columns 103 system allowing each support column to be alternately inflated at different inflation pressures. The ability to provide different inflation pressures allows changes in body pressure points, which can be used to avoid bedsores in bedridden medical patients. In one embodiment shown in FIG. 10 the height of the inflatable layer 116 is reduced. This embodiment can be used for applications where the inflatable device 100 is placed on top of an existing mattress. The embodiment of FIG. 10 can be implemented by placing the conditioned air ducts 107, 108 at each end of the conditioned air channels 102. In an embodiment (not shown), perpendicular air channels can be used to terminate the ends of the plurality of parallel air channels 102. In this embodiment, the perpendicular air channel collects the conditioned air flowing from the parallel air channels 102 eliminating the need for air ducts 107, 108. The concave shape side walls of the supporting columns 103 will bend inward under weight loads aiding the conditioned air channels 102 to stay open.

In one aspect of the invention, the inflatable support columns 103 can extend from the top surface 112 down to the inflatable bottom layer 116. These inflatable support columns 103, when inflated, should have enough structural strength, along with the inflatable side layer 115 and inflatable bottom layer 116, to support the weight of a person or other object when lying on the mattress without substantially collapsing the conditioned air channels 102 and ducts 107, 108. The approximate balancing force (f), or structural strength, provided by the plurality of inflatable support columns 103 is directly proportional to the inflation pressure (p) contained within the inflatable support columns 103 and the area of contact (a) between the person and the inflatable support columns 103, expressed in the mathematical relationship $f=p\times a$. Using this approximation for the embodiment illustrated in FIG. 3, where the inflatable support columns 103 cover approximately fifty percent of the area of contact (a) that would be provided by a conventional air mattress having no spacing between the inflatable support columns 103, the minimum inflation pressure (p) for the inflatable support columns 103 should be double the inflation pressure used in a conventional air mattress. Accordingly, the flexible thermoplastic material used for the inflatable support columns 103 should be strong enough to remain impermeable at these higher air pressures. This additional strength as compared with conventional mattresses can be provided by the use of thicker materials and/or the used of integrated non-elastic fiber.

In the embodiment of the inflatable mattress 100, the top surface 112 along with the plurality of inflatable support columns 103, inflatable bottom layer 116, and inflatable side layer 115 can form a plurality of conditioned air channels 102 through which conditioned air 101 can flow in the inflatable mattress 100. By providing sufficient air pressure in the inflatable chambers, including the inflatable support columns 103, to support the weight of a person or other objects when lying on the mattress and to prevent collapsing the inflatable support columns 103, the shape of the conditioned air channels 102 is substantially maintained under the weight to allow conditioned air 101 to flow through the inflatable mattress 100. The inflatable columns 103 should be inflated to an internal pressure such that the conditioned air channels 102 and ducts 107, 108 maintained a minimum opening of 25% under maximum designed weight loads. Since the conditioned air channels 102 and air ducts 107, 108 need not provide structural support for the inflatable mattress 100, the conditioned air 101 can be provided at atmospheric or low pressures (i.e., non-pressurized air) without the need for a large and noisy air compressor, greatly improving the portability of the inflatable mattress 100.

As opposed to the thick comfort layer, a thin top surface 112 allows for higher heat transfer and therefore for better heating and cooling. The conditioned air 101 flowing through these non-pressurized conditioned air channels 102 adjacent to the thin top surface 112 can provide a comfort zone on, and/or a few inches above, the top surface 112, which is proportional to the temperature of the top surface 112. The conditioned air 101 flowing in the conditioned air channels 102 provides this comfort zone by conducting heat toward (when using heated conditioned air 101) or away (when using cooled conditioned air 101) from the top surface 112, thereby heating or cooling the ambient air or any object in the immediate vicinity of the top surface 112. A desirable range for a comfort zone where most persons feel comfortable lies in the range between 25° C. and 30° C.

In order to maximize the energy efficiency of the system when cooling and/or heating, the top surface 112 material should have stronger heat transfer characteristics (i.e., higher thermal conductivity) than the inflatable support columns 103, side walls 113, and bottom surface 114 materials. In embodiments employing an impermeable top surface 112 to keep any conditioned air 101 from escaping from the conditioned air channels 102, the heat transfer between the ambient air at or above the top surface 112 and the conditioned air 101 flowing below the top surface 112 in the conditioned air channels 102 creates the comfort zone, largely in the form of convection heat moving through the top surface 112. Accordingly, a thin material having a high thermal conductivity should be used for an impermeable top surface 112. In other embodiments (not shown) employing a porous top surface 112, the conditioned air 101 can be allowed to leak from the conditioned air channels 102 through the top surface 112 providing additional cooling and/or heating of the comfort zone. Compared to a system with an impermeable top surface 112, a system with a porous top surface 112 can provide a higher rate of heat transfer but has lower energy efficiency as it allows the conditioned air 101 to escape.

While it is desirable to use thinner materials for the top surface 112 that have a strong heat transfer characteristic, the inflatable side layer 115, bottom layer 116, and inflatable support columns 103 should be made of materials with lower thermal conductivity to minimize undesirable heat transfer losses between the conditioned air channels 102 (and/or air ducts 107, 108) and outside environment. Surrounding the conditioned air channels 102 and air ducts 107, 108 with structures made of materials having low thermal conductivity except for the top surface 112, minimizes the system heat losses and maximizes the required quantity of cooling/heating energy of the conditioned air 101 available to control the temperature of the top surface 112.

Figure 18:
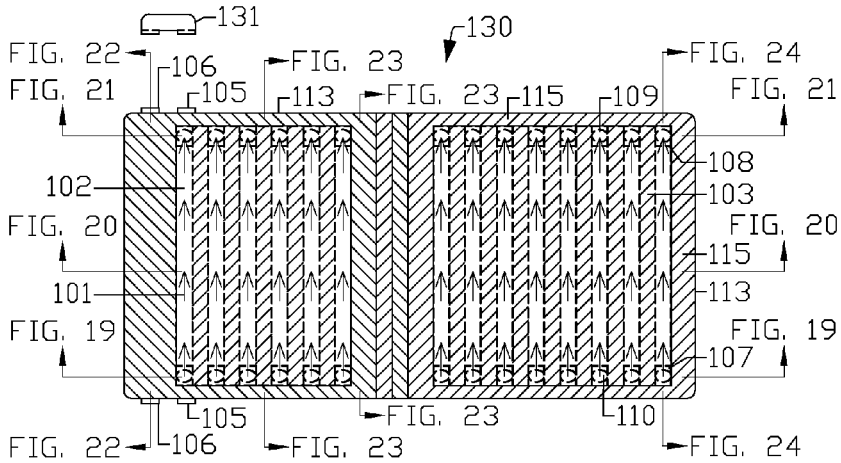
FIG. 18 is a sectional top view of an inflatable seating pad with the top surface removed, according to another embodiment of the invention.
Figure 19:
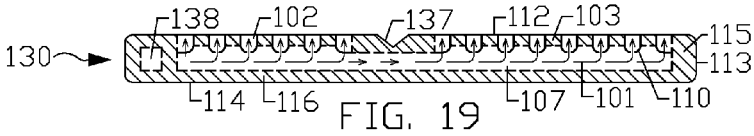
FIG. 19 is a sectional view of the inflatable seating pad in FIG. 18 along axis FIG. 19-FIG. 19, illustrating a conditioned air supply duct.
Figure 20:
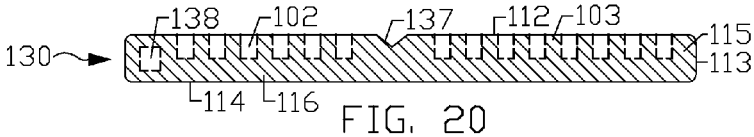
FIG. 20 is a sectional view of the inflatable seating pad in FIG. 18 along axis FIG. 20-FIG. 20, illustrating the formation of the conditioned air channels between the inflatable support columns and top surface.
Figure 21:
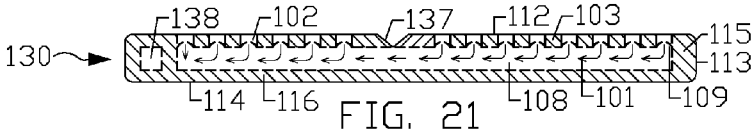
FIG. 21 is a sectional view of the inflatable seating pad in FIG. 18 along axis FIG. 21-FIG. 21, illustrating a conditioned air return duct.
Figure 22:
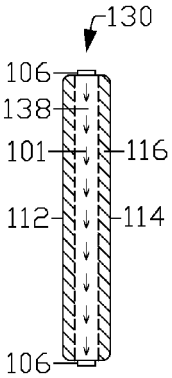
FIG. 22 is a sectional view of the inflatable seating pad in FIG. 18 along axis FIG. 22-FIG. 22, illustrating a conditioned air connecting duct.
Figure 23:
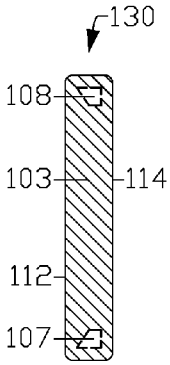
FIG. 23 is a sectional view of the inflatable seating pad in FIG. 18 along axis FIG. 23-FIG. 23, illustrating an inflatable support column and conditioned air ducts.
Figure 24:
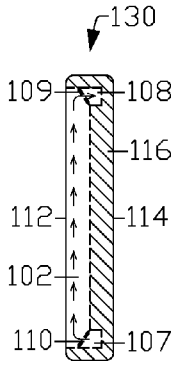
FIG. 24 is a sectional view of the inflatable seating pad in FIG. 18 along axis FIG. 24-FIG. 24, illustrating a conditioned air channel and conditioned air ducts.

The conditioned air 101 can be supplied to the inflatable mattress 100 through the supply opening 105, then through the conditioned air supply duct 107, through which the conditioned air 101 passes up through the internal supply opening 110 up into the conditioned air channels 102. Similarly, the conditioned air 101 can return (or exit) from the inflatable mattress 100 through the conditioned air channels 102, then down through the internal return opening 109, through the conditioned air return duct 108, and discharged out through the return opening 106. The configuration of the connected openings, ducts, and channels allows the conditioned air 101 to be received into the inflatable mattress 100 by the supply opening 105 and discharged from the return opening 106. In the inflatable mattress 100 embodiment, a second pair of openings 105, 106 are supplied to provide greater convenience for the user, including providing additional openings to release any conditioned air 101 remaining in the inflatable mattress 100 prior to folding for storage. The unused openings 105, 106 can be sealed by a sealing cap 111. A person of ordinary skill in the art will understand that a variety of supply and return channel and duct configurations are within the spirit and scope of the invention. For example, the conditioned air ducts 107, 108 can be reconfigured to have an air duct at each end (not shown) of the conditioned air channels 102 in a similar configuration as the conditioned air ducts and the conditioned air channels shown for embodiment 130 in FIG. 18.

Another embodiment of the invention includes an inflatable seating pad 130 as shown in FIGS. 18 through 25. The inflatable seating pad 130 contains many of the same structural features of the inflatable mattress 100 illustrated in FIGS. 3 through 11, including without limitation the formation of conditioned air channels 102 by the top surface 112 along with the plurality of inflatable support columns 103, inflatable bottom layer 116, and inflatable side layer 115. Similarly, both embodiments of inflatable devices 100, 130 can be compactly folded when not inflated. There are, however, a few structural variances between the two embodiments. For example, in the seating pad 130, a notch 137 extends across a length of an intersection of the top surface 112 and one of the inflatable support columns 103 in order to promote folding.

As with the inflatable mattress 100, the conditioned air 101 can be supplied to the inflatable seating pad 130 through the supply opening 105, then through the conditioned air supply duct 107, through which the conditioned air 101 passes up through the internal supply opening 110 up into the conditioned air channels 102. Similarly, the conditioned air 101 can return (or exit) from the inflatable seating pad 130 through the conditioned air channels 102, down through the internal return opening 109, through the conditioned air return duct 108, and out through the second supply opening 105. Based on the configuration of the inflatable seating pad 130 in this embodiment, a connecting jumper 131 can be used over the second pair of duct openings 105, 106 to complete the airflow path through the conditioned air connecting duct 138 and the return opening 106.

Figure 7:
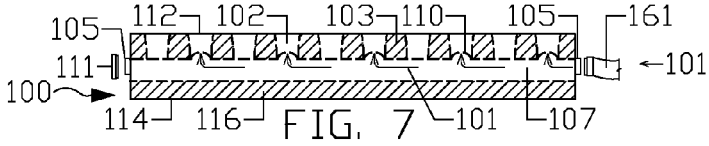
FIG. 7 is a sectional view of the inflatable mattress in FIG. 3 along axis FIG. 7-FIG. 7, illustrating a conditioned air supply duct.
Figure 8:
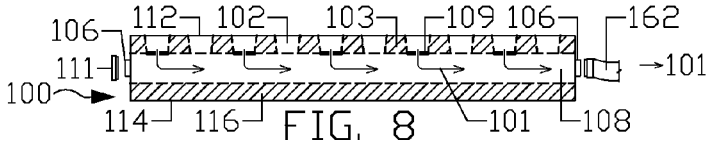
FIG. 8 is a sectional view of the inflatable mattress in FIG. 3 along axis FIG. 8-FIG. 8, illustrating a conditioned air return duct.
Figure 25:
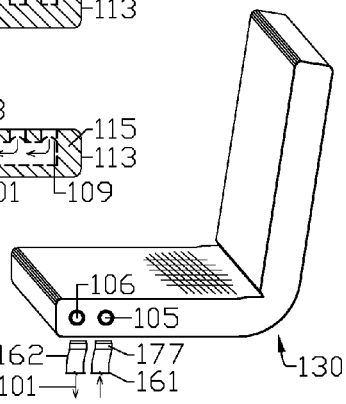
FIG. 25 is a perspective view of the inflatable seating pad in FIG. 18, illustrating the interface of the conditioned air supply and return hoses to the supply and return openings.

In one embodiment of the temperature control system includes a conditioned air control unit 160, various embodiments of which are shown in FIGS. 12 through 17. The conditioned air control unit 160 can provide cooled and/or heated conditioned air 101 to the conditioned air channels 102 of an inflatable device such as the inflatable mattress 100 or inflatable seating pad 130. As shown in FIG. 7 and FIG. 25, the conditioned air 101 can be supplied by the conditioned air control unit 160 to the inflatable device 100, 130 via a conditioned air supply hose 161 connected to the supply opening 105 with conditioned air returning to the conditioned air control unit 160 from the inflatable device 100, 130 through the return opening 106 via a conditioned air return hose 162.

Although the embodiments have been described with the conditioned air 101 being supplied to the inflatable devices 100, 130 via the supply hose, ducts, and openings and returning using the return hose, ducts, and openings, the system can instead be configured to supply conditioned air 101 via the described return configuration and return via the described supply configuration. As the conditioned air 101 travels from the supply opening 105 through the inflatable device 100, 130, by the time it returns to the return opening 106, it will be less cool (or less hot) compared to when it entered the inflatable device 100, 130 due to the heat transfer process. This difference in temperature results in the top surface 112 having variance of temperatures along its conditioned air channels 102. In one embodiment, this situation is mitigated by periodically (i.e., after the expiration of a predetermined time interval) reversing the flow direction of the conditioned air 101 by reversing the turning direction of the air blowers 168 connected to the conditioned air hoses 161, 162.

The conditioned air hoses 161, 162 can be identical to allow for interchangeability. The conditioned air hoses 161, 162 can be constructed of flexible plastic and should possess sufficient structural strength to maintain an open circular cross section. In addition, the materials used for the conditioned air hoses 161, 162 should have poor heat transfer characteristic (i.e., low thermal conductivity) to minimize the heat transfer between the conditioned air 101 traveling in the conditioned air hoses 161, 162 and the ambient air. To facilitate connection to the openings 105, 106 of the inflatable devices 100, 130 and to the conditioned air control unit 160, the conditioned air hoses 161, 162 can be provided with hose end connectors 177 of the twist or snap-in type.

Figure 12:
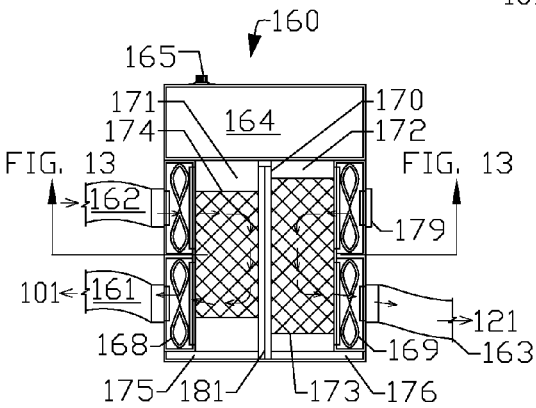
FIG. 12 is a sectional view of a conditioned air control unit.
Figure 13:
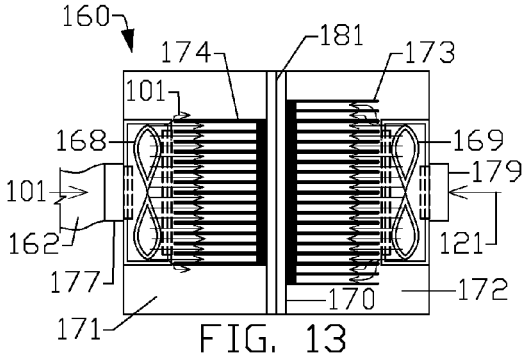
FIG. 13 is sectional view the conditioned air control unit in FIG. 12 along axis FIG. 13-FIG. 13.

As shown in FIG. 12, one embodiment of the conditioned air control unit 160 can comprise a thermoelectric heat pump 170 known as a Peltier module, which is widely used as a solid state heat pump for small and localized heating and cooling applications. The thermoelectric heat pump 170 can comprise two air chambers 171, 172 each including a heat exchanger 174, 173 respectively. The air chambers 171, 172 can be provided with a pair of air blower fans 168, 169 or the fans can be integrated with the thermoelectric heat pump similar to model number MAA150T-24 as manufactured by Melcor. In one embodiment (not shown), the air cambers 171, 172 each can be provided with an air blower fan similar to model number AA-150-24-22 as manufactured by Melcor.

The heat exchangers 173, 174 are separated by a heat transfer junction 181 and can comprise heat sinks made of aluminum, which has strong heat transfer characteristics. The thermoelectric heat pump 170 can be powered by DC voltages (e.g., in the range of 12 VDC to 48 VDC). The power supply and related circuitry for the thermoelectric heat pump 170 can be housed in the circuit and power supply compartment 164. The DC power supply can be a switching mode power supply and can be used to provide power to the thermoelectric heat pump 170, blower fans 168, 169, and any control circuits. In one embodiment, the circuit and power supply compartment 164 can be provided with a connection for an external power supply (e.g., a battery).

In cooling operation, the temperature of the conditioned air heat exchanger 174 decreases and the temperature of the ambient air heat exchanger 173 increases. As shown in FIG. 12, when conditioned air 101 passes through the conditioned air chamber 171, heat is transferred from the conditioned air 101 to a lower temperature conditioned air heat exchanger 174, thereby cooling the conditioned air 101. Similarly, when ambient air passes through the ambient air chamber 172, heat is transferred from a higher temperature ambient air heat exchanger 173 to the ambient air, thereby cooling heat exchanger 173. The heating operation is performed by reversing the polarity of the voltage applied to the thermoelectric heat pump wherein the temperature of the conditioned air heat exchanger 174 increases and the temperature of the ambient air heat exchanger 173 decreases. The addition of a heating device (not shown) in the air chambers 171, 172 can provide additional heating as well as humidity and moisture control functions. The heater device can be of wire wound or resistor types. In order to collect moisture due to condensation in the air chambers 171, 172 the water reservoirs 175, 176 can be provided.

To minimize heat transfer losses with the external environment, the walls of the air chambers 171, 172 can be made of a thermoplastic material that exhibits poor heat transfer characteristics and good thermal isolation characteristics. In one embodiment, the interior walls of the air chambers 171, 172 can be coated with a metallic paint to minimize heat transfer caused by radiation.

Figure 14:
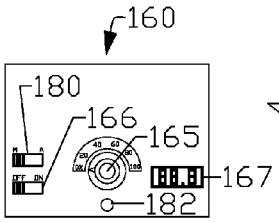
FIG. 14 is a top view of the conditioned air control unit in FIG. 12, illustrating the user interface devices.

As shown in FIG. 14, one embodiment of the conditioned air control unit 160 can include user interface devices, including, without limitation, a power switch 166 for turning on/off the conditioned air control unit 160, an adjustment control knob 165 for setting the desired temperature of the conditioned air 101, a manual/automatic selector switch 180, a display 167, and a power on indicator 182. In one embodiment, the user interface devices are wired to or otherwise in communication with a microprocessor (not shown) located in circuit and power supply compartment 164. The microprocessor can control the temperature and flow rate. Sensors can be used in conjunction with the microprocessor to monitor the temperature and flow rate of the conditioned air 101 passing through the air chambers 171, 172. The system can be run in manual mode, in which a user sets the desired air temperature and flow rate of the conditioned air 101, or it can be run in automatic mode, where the user sets the desired temperature of the conditioned air 101, and the microprocessor automatically determines and adjusts the temperature and flow rate of the conditioned air 101. In the embodiment shown in FIG. 12, the conditioned air control unit 160 is configured to provide conditioned air 101 to the inflatable device 100, 130. In this configuration, the conditioned air 101 moves in a closed-loop air flow system, drawn into the conditioned air chamber 171 by one of the conditioned air chamber blower fans 168, forced out of the air chamber 171 by the other air chamber blower fan 168 through the conditioned air supply hose 161, then circulated through the conditioned air supply duct 107, conditioned air channels 102, conditioned air return duct 108, before returning to the conditioned air chamber 171 via the conditioned air return hose 162. In this configuration, ambient air moves in an open-loop flow, drawn into the ambient air chamber 172 through an air filter 179 by one of the air chamber blower fans 169, forced out of the ambient air chamber 172 as exhaust air 121 by the other air chamber blower fan 169, through the exhaust air hose 163.

The exhaust air hose 163 can be constructed similar to the conditioned air hoses 161, 162 and can be used to dump the exhaust air 121 out of the environment of the inflatable device 100, 130. For example, when the inflatable device 100, 130 is used in a bedroom or living room, the air exhaust hose 163 can be used to direct the exhaust air 121 out through a window or door opening.

Figure 15:
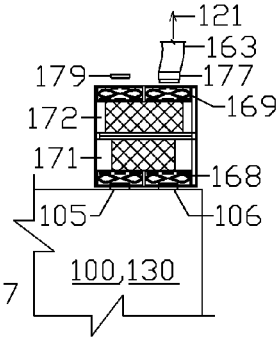
FIG. 15 is a sectional top view of a conditioned air control unit according to another embodiment.

In another embodiment of the conditioned air control unit 160 shown in FIG. 15, the conditioned air hoses 161, 162 are not used as the air chamber blower fans 168 are connected directly to the inflatable device 100, 130 via the conditioned air duct openings 105, 106. This embodiment can also be provided without the power supply compartment 164 to make the conditioned air control unit 160 more compact through the use of an external power supply. In one embodiment (not shown) the conditioned air control unit 160 of FIG. 15 is built embedded into the inflatable device 100, 130. This embodiment is similar to an existing air mattress having an integrated air pump system.

Figure 16:
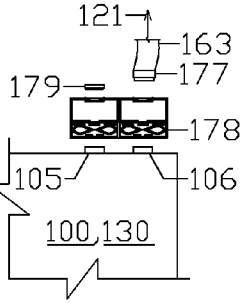
FIG. 16 is a sectional top view of a blower fan unit according to another embodiment.

FIG. 16 illustrates an embodiment using a blower fan unit 178 connected directly to the inflatable device 100, 130 via the openings 105, 106. The embodiment shown in FIG. 16 can be used in environment where the ambient air will provide some level of cooling which might be the case, e.g. when the inflatable device is placed on the floor or at ground level. The cooler ambient air can be used to provide cooling of the top surface 112 of the inflatable device 100, 130, and therefore, for providing a level of comfort by removing the trapped body heat. In the embodiment depicted in the figure, ambient air is drawn into the supply opening 105 by one of the fans in the blower fan unit 178, circulated through the inflatable device 100, 130, and returned out of the inflatable device 100, 130 by the other fan in the blower fan unit 178 as exhaust air 121 through the exhaust air hose 163 in an open-loop configuration. This embodiment can also be used for removing moisture out of the inflatable device 100, 130 after use.

Figure 17:
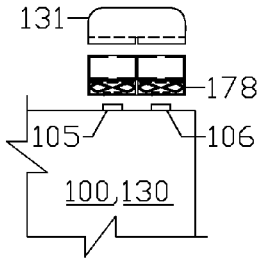
FIG. 17 is a sectional top view of a heater/blower fan combination unit according to another embodiment.

FIG. 17 illustrates an embodiment where a simpler heating system is used. This embodiment is similar to FIG. 16 except that a heating device (not shown) is enclosed within the blower fan unit 178. This embodiment can also be used in a closed-loop air flow system by connecting a jumper that reroutes exhaust air 121 back into the inflatable device 100, 130. This connecting jumper can be similar to the connecting jumper 131 shown in FIG. 18. Such an embodiment would require minimal power consumption during heating operation.

FIG. 28 through FIG. 42 illustrate additional embodiments of the inflatable mattress 100 where the non-pressurized channels 102 are interconnected to allow a single flow path. This single flow path makes the conditioned fluid 101 to circulate with the same flow rate through each non-pressurized channel 102. The single flow path is constructed by configuring the non-pressurized channels 102 in a series connection, where the end of a channel 102 is connected with the other end of the next channel 102.

Figure 28:
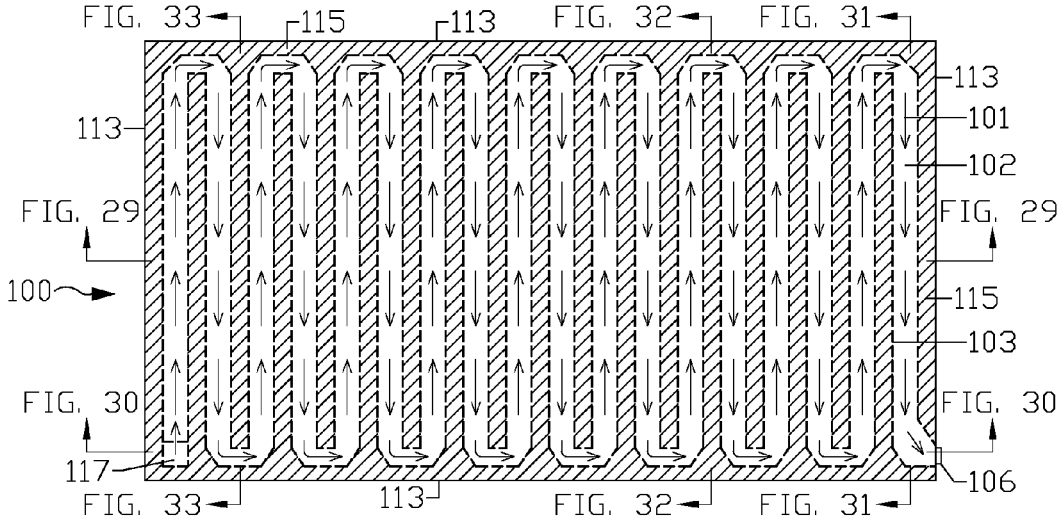
FIG. 28 is a sectional top view of a single flow inflatable mattress with the top surface removed.
Figure 29:
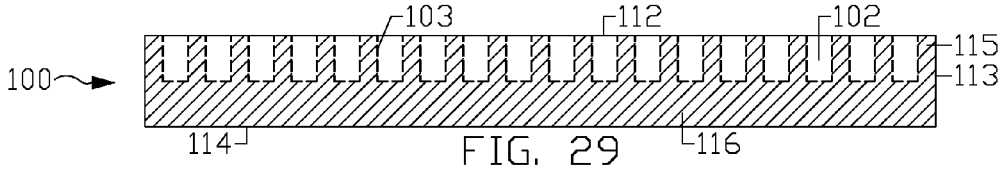
FIG. 29 is a sectional view of the inflatable mattress in FIG. 28 along axis FIG. 29-FIG. 29 illustrating the non-pressurized channels and inflatable support columns.
Figure 30:
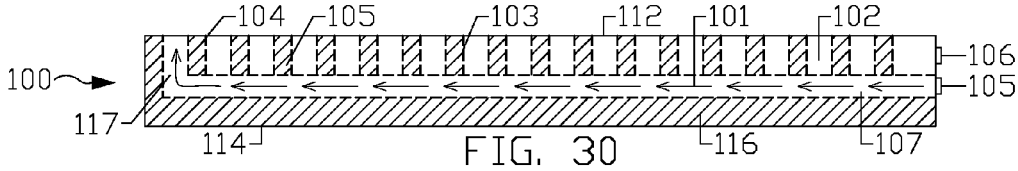
FIG. 30 is a sectional view of the inflatable mattress in FIG. 28 along axis FIG. 30-FIG. 30 illustrating the non-pressurized duct and non-pressurized channels.
Figure 31:
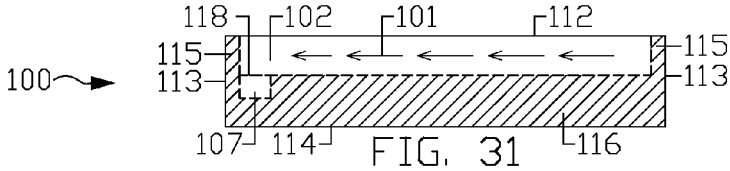
FIG. 31 is a sectional view of the inflatable mattress in FIG. 28 along axis FIG. 31-FIG. 31 illustrating a non-pressurized channel.
Figure 32:
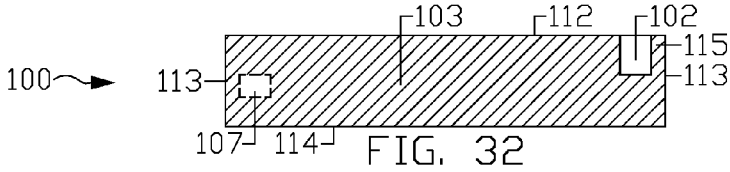
FIG. 32 is a sectional view of the inflatable mattress in FIG. 28 along axis FIG. 32-FIG. 32 illustrating a support column.
Figure 33:
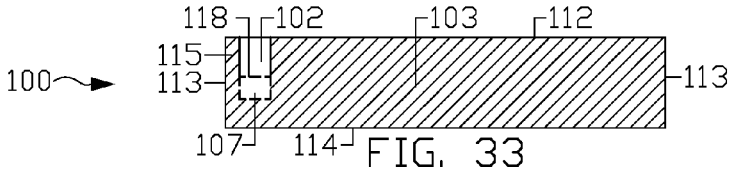
FIG. 33 is a sectional view of the inflatable mattress in FIG. 28 along axis FIG. 33-FIG. 33 illustrating another support column.

FIG. 28 illustrates a single flow embodiment of the inflatable mattress 100. The non-pressurized channels 102 and the non-pressurized duct 107 are connected in series to have a single flow of conditioned fluid 101 throughout the entire inflatable mattress 100.

Figure 34:
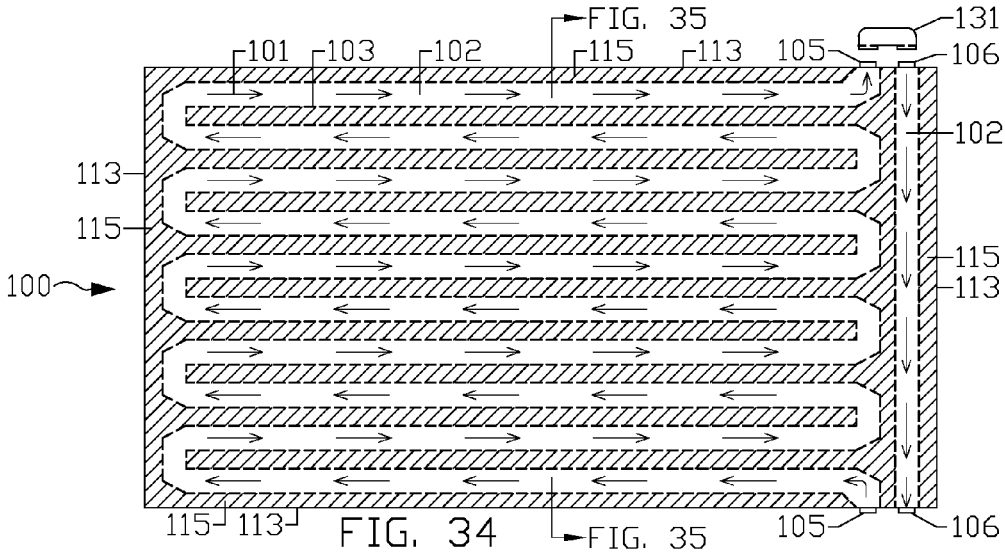
FIG. 34 is a sectional top view of a single flow ductless inflatable mattress with the top surface removed.
Figure 35:
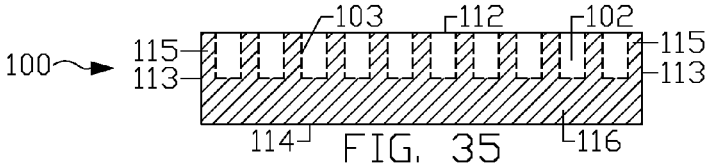
FIG. 35 is a sectional view of the inflatable mattress in FIG. 34 along axis FIG. 35-FIG. 35.
Figure 36:
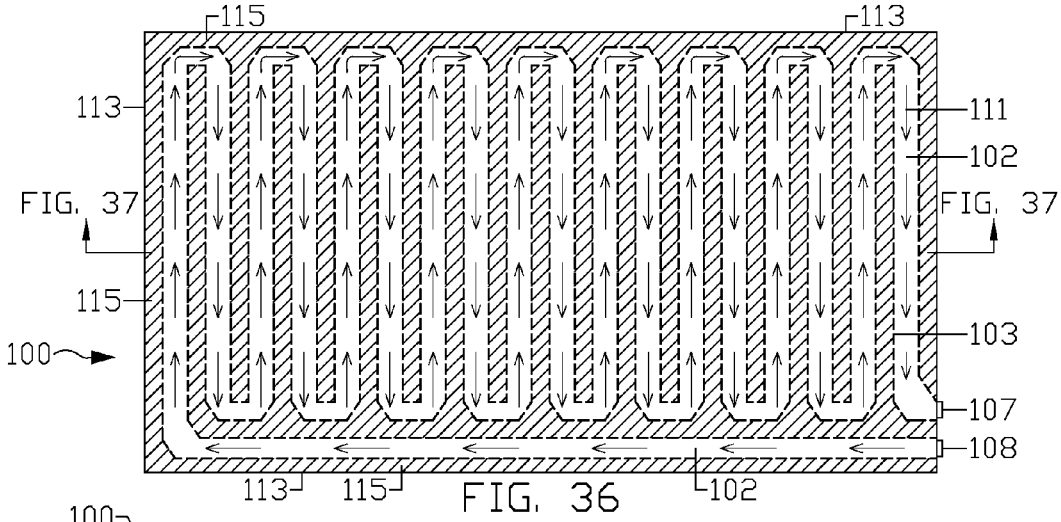
FIG. 36 is a sectional top view illustrating another embodiment of a single flow ductless mattress.
Figure 37:
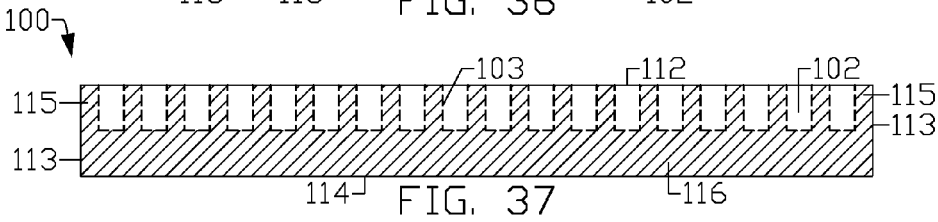
FIG. 37 is a sectional view of the inflatable mattress in FIG. 36 along axis FIG. 37-FIG. 37.

FIG. 34 and FIG. 36 illustrate ductless single flow embodiments of the inflatable devices 100. FIG. 34 shows a connecting jumper 131 used for externally connecting two channels 102.

Figure 38:
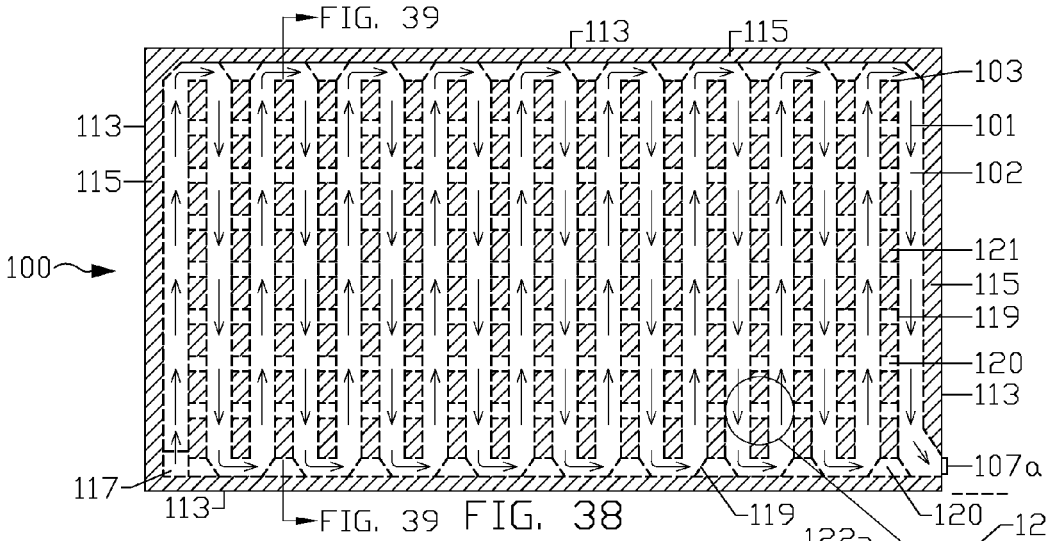
FIG. 38 is a sectional top view of another embodiment of an inflatable mattress illustrating discontinuous rectangular support columns.
Figure 39:
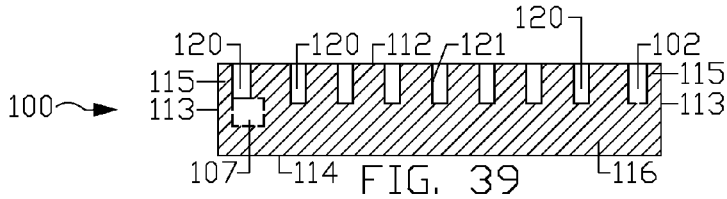
FIG. 39 is a sectional view of the inflatable mattress in FIG. 38 along axis FIG. 39-FIG. 39.
Figure 40:
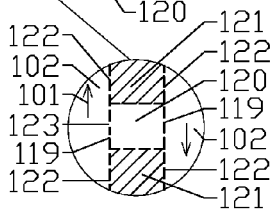
FIG. 40 is an enlarged detail of the discontinuous rectangular support columns.
Figure 41:
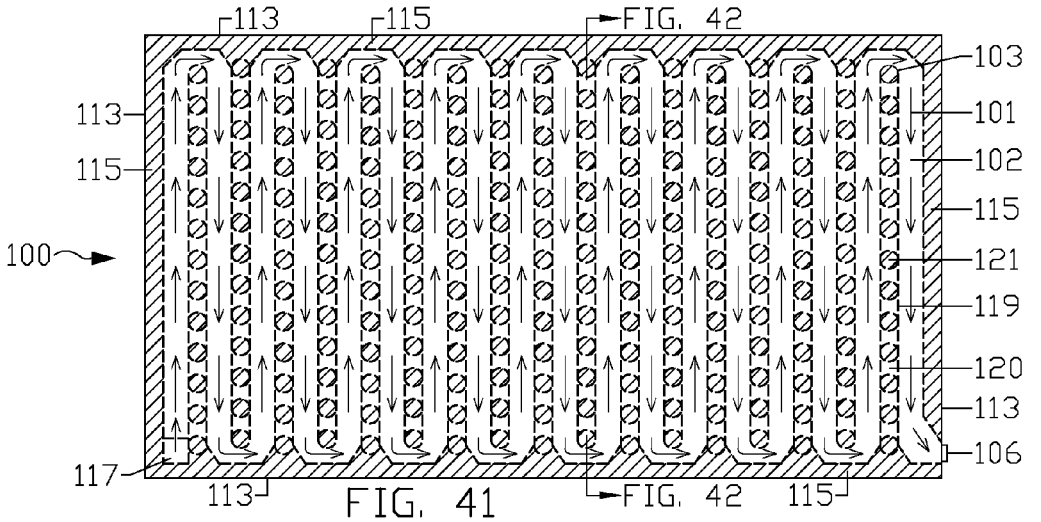
FIG. 41 is a sectional top view of another embodiment of an inflatable mattress illustrating discontinuous cylindrical support columns.
Figure 42:
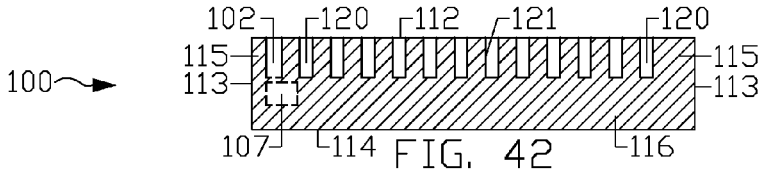
FIG. 42 is a sectional view of the inflatable mattress shown in FIG. 41 along axis FIG. 42-FIG. 42.

FIG. 38 and FIG. 41 illustrate single flow embodiments of the inflatable devices 100 where each inflatable support column 103 is segmented to have a plurality of alternate inflatable pillars 121 and non-pressurized compartments 120. As illustrated in FIG. 40, each non-pressurized compartment 120 is located between two inflatable pillars 121, and it is formed by connecting the side surfaces 122 of two pillars 121 with a bridging sheet 119 made out of natural fiber, rubber, polymer, or other thermoplastic materials used for the construction of inflatable devices such as air mattresses, seats, etc. Each bridging sheet 119 substantially connects the side surfaces 122 of two inflatable pillars 121 located along the same channel 102. The bridging sheet 119 provides each non-pressurized channel 102 with a smooth path and substantially minimizes the occurrence of flow turbulences of the conditioned fluid 101. The bridging sheet 119 can be attached to the side surfaces 122 of the inflatable pillars 121. If each bridging sheet 119 is attached to the side surface 122 sealing each non-pressurized compartment 120, then, a small inflation-deflation opening 123 can be provided in one of the two bridging sheets 119. The opening 123 allows each compartment 120 to expand when the inflatable pillars 121 are being inflated and to collapse when the inflatable pillars 121 are being deflated. In another embodiment (not shown), the bridging sheet 119 can be constructed as a circular strip of bridging sheet 119 capable of enclosing the plurality of inflatable pillars 121 and non-pressurized compartments 120 to form a single inflatable support column 103. The width of the strip can be equal to the height of the inflatable pillars 121. The strip of bridging sheet 119 can be placed around the plurality of inflatable pillars 121 to simplify the construction of each inflatable support column 103. The inflatable pillars 121 can be made of any shape, for instance, FIG. 38 shows rectangular inflatable pillars 121 while FIG. 41 shows cylindrical inflatable pillars 121.

Figure 26:
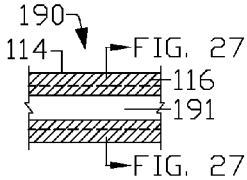
FIG. 26 is a sectional view along a pipe main axis illustrating one embodiment of the invention where the inflatable device is used to control the temperature of a pipe.
Figure 27:
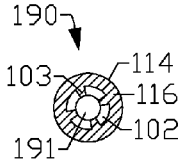
FIG. 27 is a sectional view along the axis FIG. 27-FIG. 27 in figure FIG. 26, illustrating the inflatable support columns, the conditioned air channels, and the inflatable bottom layer.

The inventive concept of creating ducts and channels used to transport non-pressurized fluids within an inflatable structure can be implemented in numerous embodiments for which the supporting structure is required to be portable, light weight, low cost, and structurally safe, in addition to the ease of manufacturing, the inflatable device can take on any desired geometry or shape. In those embodiments used for heating/cooling applications, the material to be transported or circulated within the inflatable device is a substance in the form of a conditioned fluid flowing through a plurality of non-pressurized channels adjacent to at least one external surface of the inflatable device. Accordingly, although the embodiments disclosed above are directed to an inflatable mattress and an inflatable seating pad to provide temperature control for a person, a person skilled in the art would understand that the invention can also be used in a variety of other applications, including, without limitation, mattresses, pads, blankets, cushions, sleeping bags, tents, articles of clothing, etc. in a variety of locations, including, without limitation, homes, cars, airplanes, etc. as the inflatable device can be made of any shape to contact an object (e.g., a person or a pipe to prevent freezing) to which heating and/or cooling is applied. For example, the claimed inventive concept can be used as an inflatable heat tracing device 190 as shown in FIGS. 26 and 27. This embodiment depicts an inflatable device that has been manufactured to fit a pipe 191 wherein the conditioned air channels 102 are formed within the inflatable columns 103 and the pipe 191 to be heated. The inflatable bottom layer 116 provides a thermal shield that isolates the pipe 191 from the environmental elements.

In addition, although the embodiments disclosed in the application use air to both inflate the inflatable devices as well as air to provide the cooling and/or heating, a person of ordinary skill in the art would understand that the use of a variety of other inflation or flow fluids (gases or liquids (water)) to perform one or both of these functions is within the intent and scope of the invention. For instance, the use of water as a low pressurized refrigerant fluid can be implemented by using a thermoelectric recirculation liquid chiller similar to MCR150DH2-HT-DVA as manufactured by Melcor, where a liquid-to-air system Peltier module is used.

This written description uses examples to disclose the invention, including the best mode, and also to enable any person skilled in the art to make and use the invention. The patentable scope of the invention is defined by the claims, and may include other embodiments that occur to those skilled in the art. Such other embodiments are intended to be within the scope of the claims if they have structural elements that do not differ from the literal language of the claims, or if they include equivalent structural/functional elements with insubstantial differences from the inventive concept herein claimed.

What is claimed is:

1. An inflatable device comprising:

a first surface;

a second surface, opposite said first surface;

a first side wall between said first and second surfaces;

a second side wall opposite said first side wall and between said first and second surfaces;

a plurality of columns extending from the interior of said first surface toward the interior of said second surface and extending along said interior of said first surface for a substantial portion of the distance between said first side wall and said second side wall; and a plurality of channels, wherein each of said channels substantially occupies the space between two of said columns and said interior of said first surface and extending along said interior of said first surface for a substantial portion of said distance between said first side wall and said second side wall, wherein said columns are capable of containing the inflation pressure of said inflatable device in such a way as to allow a fluid to flow through each of said channels at substantially lower pressure levels than said inflation pressure, wherein said plurality of said channels is configured to form a single path capable of allowing each of said channels to carry said fluid with equal flow rate.

2. The inflatable device of claim 1, wherein each of said columns comprises a plurality of pillars capable of containing said inflation pressure of said inflatable device, and said plurality of said pillars is configured such that each of said pillars is separated from the next pillar at a regular distance.

3. The inflatable device of claim 2, wherein the space between two of said pillars is enclosed by two sheets, each of said sheets substantially bridges the side surfaces of said pillars, and each of said side surfaces is located along each of the two channels adjacent to said pillars.

4. The inflatable device of claim 1, wherein said plurality of said columns and said plurality of said channels form an array of alternating columns and channels.

5. The inflatable device of claim 1, further comprising at least a duct connected with said plurality of said channels in such a way that said fluid passes through said duct at substantially lower pressure levels than said inflation pressure.

6. The inflatable device of claim 1, wherein said fluid is conditioned to control the temperature of the portion of said first surface above said plurality of said channels.

7. The inflatable device of claim 1, wherein said plurality of columns is impermeable.

8. The inflatable device of claim 1, wherein said first surface is impermeable.

9. The inflatable device of claim 1 further comprising a layer formed on said interior of said second surface, wherein said layer is capable of containing said inflation pressure.

10. The inflatable device of claim 9, wherein said plurality of said columns extends from said first surface to said layer.

11. The inflatable device of claim 10, wherein said layer is separately inflatable from said plurality of said columns.

12. The inflatable device of claim 1, wherein at least one of said columns is separately inflated from said plurality of said columns.

13. The inflatable device of claim 1, wherein said inflatable device is a mattress.

14. The inflatable device of claim 1, wherein said inflatable device is a seating pad.

15. The inflatable device of claim 1, wherein said fluid is air.

16. The inflatable device of claim 1, wherein said inflatable device can be folded when not inflated.

17. The inflatable device of claim 1, wherein said inflatable device is interconnected to a control unit, said control unit comprises means for forcing said fluid to flow in such a way that said fluid exiting said control unit enters said inflatable device and said fluid exiting said inflatable device enters said control unit.

18. The inflatable device of claim 17, wherein said control unit comprises means for heating and cooling said fluid.

19. An apparatus used for providing heating and cooling through at least one of the external surfaces of said apparatus, the apparatus consisting of an inflatable device comprising means to allow a fluid to flow at substantially lower pressure levels than the inflation pressure of said inflatable device, the means comprising a plurality of channels located in substantial proximity to the interior of said external surface of said inflatable device, and each of said channels substantially extending between two sides defining the perimeter of said external surface, and wherein the volume of each of said channels substantially occupies the space between two columns and said interior of said external surface, wherein each of said columns is capable of containing said inflation pressure of said inflatable device, wherein the interconnection among said channels is configured in such a way as to form a path capable of allowing said fluid to move with equal flow rate through each of said channels, wherein said channels and said columns form an array of alternating columns and channels substantially extending between said the perimeter of said external surface.

20. The apparatus of claim 19, wherein each of said columns comprises a plurality of pillars capable of containing said inflation pressure of said inflatable device, and each of said pillars is a space apart from the next pillar.

21. The apparatus of claim 19, wherein each of said spaces between two of said pillars is limited between two sheets, each of said sheets substantially connects the side surfaces of said pillars in such a way as to make the two channels next to said pillars substantially continuous.

22. The apparatus of claim 19, wherein the material of said inflatable device capable of containing said inflation pressure is impermeable.

23. The apparatus of claim 19, wherein said inflatable device further comprising a control unit configure to allow said fluid to move in a closed path, said path comprising said plurality of said channels and said control unit, and wherein said control unit comprises means for forcing said fluid to move such that said fluid that exits said inflatable device enters said control unit and said fluid that exits said control unit enters said inflatable device.

24. The apparatus of claim 23, wherein said control unit comprises means for heating and cooling said fluid.

25. The inflatable device of claim 19, further comprising at least a duct connected to said plurality of said channels in such a way that said fluid passes through said duct at substantially lower pressure levels than said inflation pressure of said inflatable device.

26. The inflatable device of claim 19, wherein at least one of said columns is separately inflated from said plurality of said columns.

* * * * *